US007172541B2

(12) United States Patent
Boland et al.

(10) Patent No.: US 7,172,541 B2
(45) Date of Patent: Feb. 6, 2007

(54) ABDOMINAL EXERCISE MACHINE

(76) Inventors: Kevin O. Boland, 5623 Massachusetts Ave., Bethesda, MD (US) 20816; Cornell S. Marschalko, 941 Saigon Rd., McLean, VA (US) 22102

( * ) Notice: Subject to any disclaimer, the term of this patent is extended or adjusted under 35 U.S.C. 154(b) by 165 days.

(21) Appl. No.: 11/012,249

(22) Filed: Dec. 16, 2004

(65) Prior Publication Data

US 2005/0137068 A1 Jun. 23, 2005

Related U.S. Application Data

(60) Provisional application No. 60/530,252, filed on Dec. 18, 2003.

(51) Int. Cl.
*A63B 26/00* (2006.01)
*A63B 71/00* (2006.01)

(52) U.S. Cl. ..... 482/140; 482/907; 482/91; 482/142

(58) Field of Classification Search ..... 482/142, 482/140, 148, 91, 907, 117; D21/662, 665, D21/676, 686, 687, 690
See application file for complete search history.

(56) References Cited

U.S. PATENT DOCUMENTS 6,500,099 B1 12/2002 Eschenbach ..... 482/57
2006/0100076 A1* 5/2006 Savage et al. ..... 482/142

* cited by examiner

*Primary Examiner*—Lori Amerson
(74) *Attorney, Agent, or Firm*—Brady, O'Boyle & Garew

(57) ABSTRACT

An abdominal exercise machine having a floor supported bench and a mast pivotally connected to an end of the bench by a universal joint connection. A pair of double acting hydraulic cylinders are pivotally connected between the end of the bench and the mast. The connection of the cylinders to the bench is a universal joint connection. A footrest assembly is connected to the mast. A recumbent exerciser can not only exercise the main and lower abdominal muscles by pushing and pulling the mast against the resistance of the hydraulic cylinders in a back and forth direction aligned with the longitudinal axis of the bench, but also the side or oblique muscles by simultaneously pivoting the mast back and forth in a transverse direction. The machine also allows a combination of the above motions including a circular type motion in either direction, clockwise or counterclockwise.

11 Claims, 2 Drawing Sheets

ABDOMINAL EXERCISE MACHINE

CROSS-REFERENCE TO RELATED APPLICATION

This application claims the benefit of Provisional Patent Application Ser. No. 60/530,252 filed Dec. 18, 2003.

BACKGROUND OF THE INVENTION

Various abdominal exercise machines have been proposed including a recumbent leg pull/push exercise device wherein the recumbent, prone on his or her back with the knees bent above the upper body and the feet placed against a resistance component, moves the feet in a pedaling, pull/push movement.

While these machines have been satisfactory for their intended purpose, they have been characterized by their limited range of the abdominal muscles being exercised. For instance, in prior pull/push exercise devices, as disclosed in U.S. Pat. No. 6,500,099 dated Dec. 31, 2002, the recumbent pedals back and forth against the resistance component in one direction, to thereby exercise the abdominals, back and leg muscles; however, this one directional movement does not exercise the recumbent's oblique or side abdominal muscles, and also has a limited effect on the main abdominal muscles.

After considerable research and experimentation, the abdominal exercise machine of the present invention has been devised for exercising the entire abdominal muscles; namely, main, lower and sides (obliques). This machine also affords a vigorous workout for one's hips, thighs and buttocks.

SUMMARY OF THE INVENTION

The abdominal exercise machine of the present invention comprises, essentially, a floor supported bench having a mast pivotally connected to one end of the bench by a universal pivot connection. In the preferred embodiment, a full length bench is provided to also support the head of the user. Alternatively, the bench could be half as long and end in the middle of the user's back. A pair of double acting hydraulic cylinders are pivotally connected between the one end of the bench and the mast. The connection of each cylinder to the end of the bench is a universal pivot connection. A foot rest having a heel support is fixed to the upper end portion of the mast and a spring biased bolster is slidably mounted on the mast above the foot rest, whereby the recumbent's instep is engaged by the bolster to hold the feet on the foot rest, and to prevent the feet of the user from sliding out of the foot rest when working the legs/feet.

By this construction and arrangement, the recumbent user cannot only exercise the main and lower abdominal muscles by pushing and pulling the mast against the resistance of the hydraulic cylinders in a back and forth direction aligned with the longitudinal axis of the bench, but also the side or oblique muscles by simultaneously pivoting the mast back and forth in a transverse direction. This back and forth motion and side-to-side motion and combinations thereof not only isolates the obliques but also is superior in main abdominal stimulations. One of the main motion modes for the mast would be a circular type motion in either a clockwise or counter-clockwise direction. At all times, the mast has resistance from any point to any other point.

The lower end of the mast is connected to the end of the bench by a spring biased detent, to thereby provide multiple settings for varying the resistance of the hydraulic cylinders.

The mast is configured in an S-shape to position the foot rest closer to the end of the bench which allows the use of a shorter bench, whereby the recumbent utilizes the whole bench with no wasted space.

A pair of arms are pivotally connected to the sides of the bench, and handles are connected to the free ends of the arms adapted to be grasped by the recumbent. The arms not only make the recumbent feel secure while rotating and twisting the lower body for a complete and effective abdominal workout, but they also stabilize the machine when in use.

DESCRIPTION OF THE PREFERRED EMBODIMENT

Figure 1:
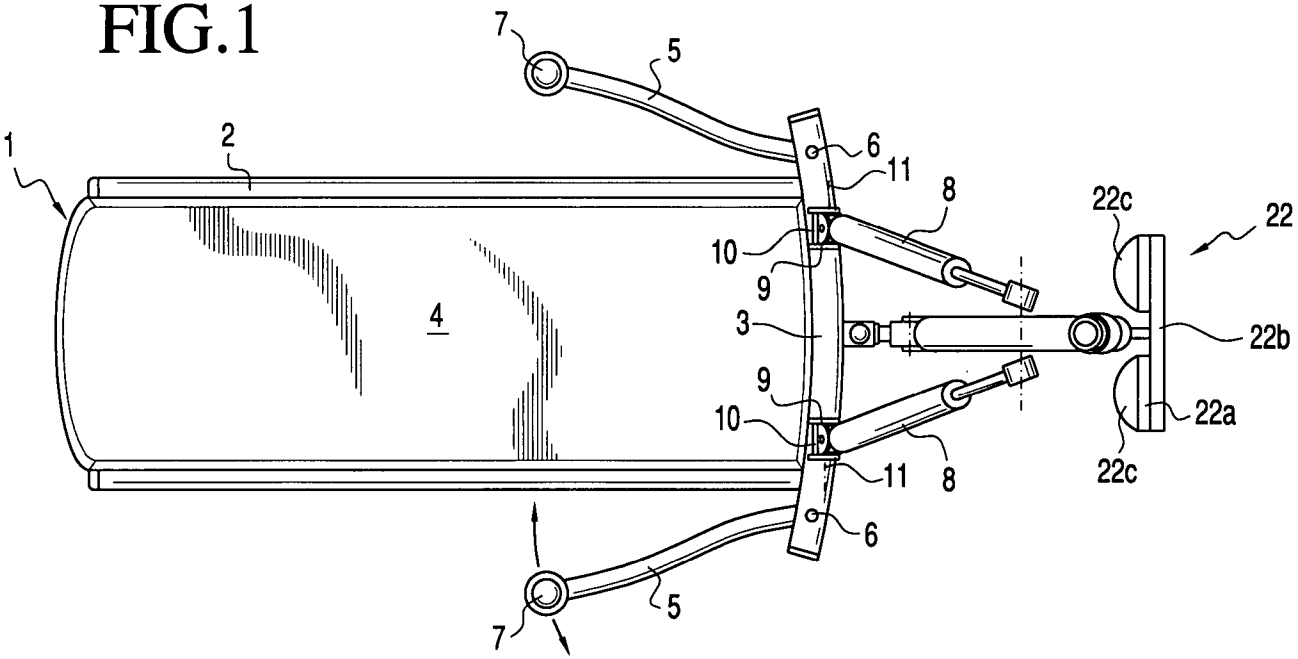
FIG. 1 is a top plan view of the abdominal exercise machine of the present invention.
Figure 2:
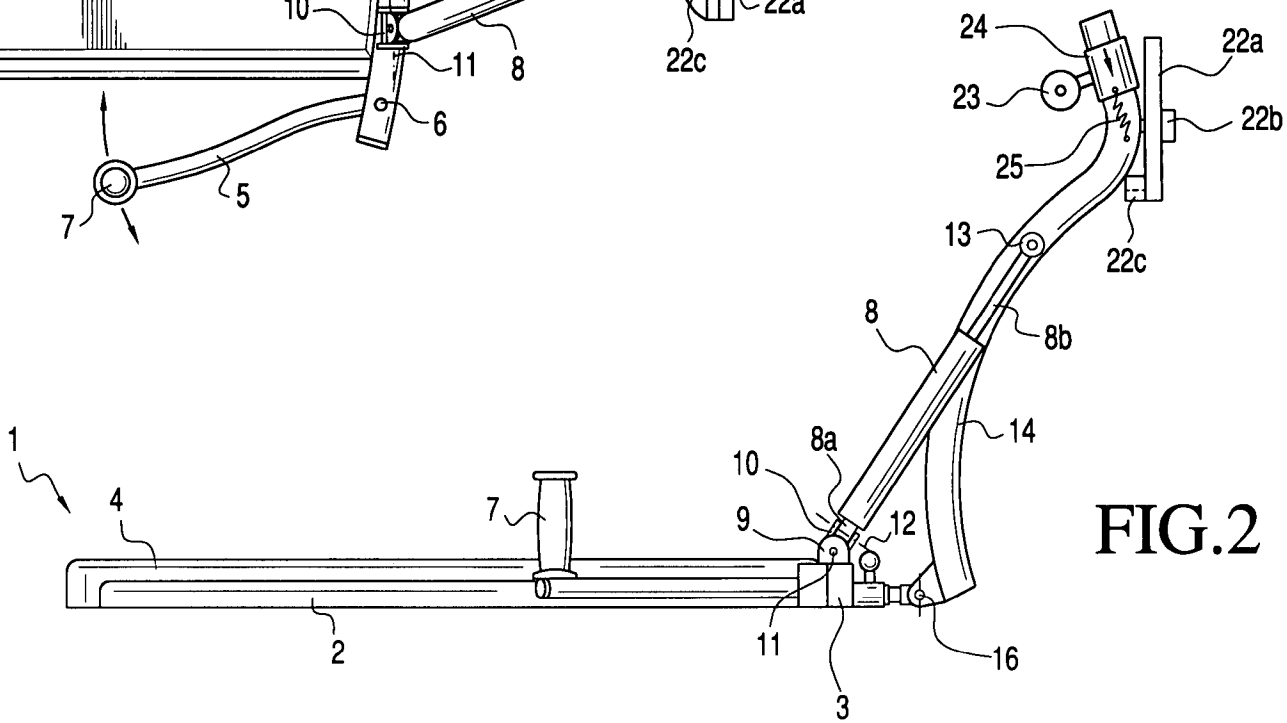
FIG. 2 is a side elevational view of the machine.

Referring to the drawings and more particularly to FIGS. 1 and 2, the abdominal exercise machine 1 of the present invention comprises a bench having a pair of longitudinally extending tubular members 2 interconnected at one end by a transversely extending tubular member 3, to thereby provide a frame for supporting a mattress 4.

A pair of arms 5 are pivotally connected to the outer end portions of the transverse tubular member 3, as at 6, and a handle 7 is connected to the free end of each arm 5.

A pair of double-acting fluid cylinders 8 are connected at one end to the transverse member 3 by a bracket 9 integral with the transverse member 3. A clevis 10 is pivotally connected to the bracket about a transverse axis, as at 11, and the cylinder end 8*a* is pivotally connected, as at 12, to the clevis 10, which pivotal connection is normal to the axis of the pivot 11, thereby providing a universal connection between the cylinder end 8*a* of each double-acting cylinder 8 and the bench, whereby the double-acting cylinders can move not only back and forth along the longitudinal axis of the bench but also from side to side transversely to the bench.

The rod end 8*b* of each double acting cylinder 8 is pivotally connected as at 13 to the medial portion of a mast 14 having its lower end pivotally connected to the transverse member 3.

Figure 4:
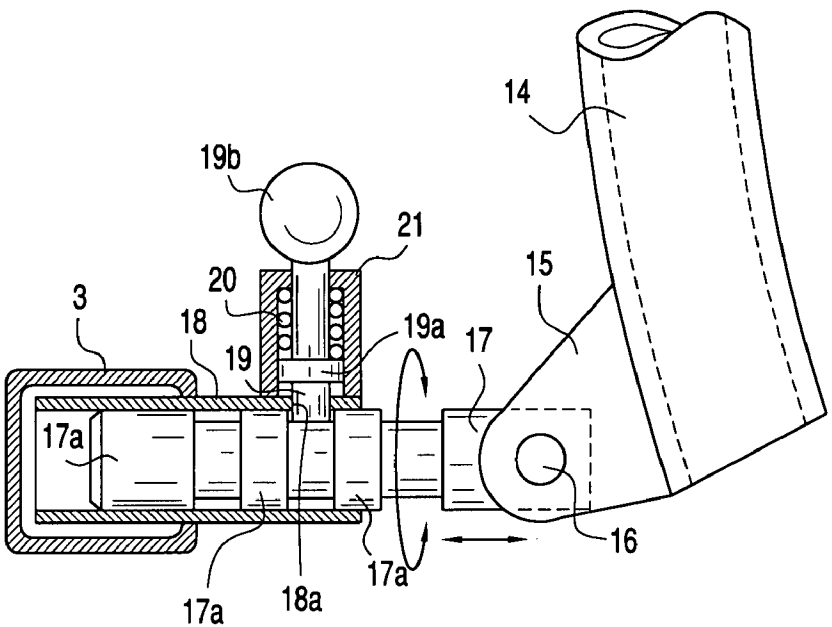
FIG. 4 is an enlarged fragmentary view of the spring biased detent and the universal pivot connection of the mast to the end of the bench.

The details of the construction of the pivotal connection of the mast 14 to the transverse member 3 are illustrated in FIG. 4. A bracket 15 is integrally connected to the lower end portion of the mast 14 and the bracket 15 is pivotally connected as at 16 to an end of a stub shaft 17 slidably and rotatably mounted in a sleeve 18 fixed to the transverse member 3. The shaft 17 is provided with axially spaced lands 17*a*. The space between the lands 17*a* is adapted to receive the end of a plunger 19 extending through an opening 18*a* in the sidewall of the sleeve 18. The plunger 19 is biased inwardly toward the shaft 17 by a compression spring 20 biased between an end wall of a housing 21 fixed to the sleeve 18 and a flange 19*a* on the plunger 19. The free end of the plunger 19 is provided with a spherical handle 19*b* to facilitate the manual pulling of the plunger 19 outwardly from the space between the lands 17*a*, whereby the axial position of the shaft 17 within the sleeve 18 can be adjusted to thereby vary the position of the mast pivot 16, whereby the resistance of the hydraulic cylinders 8 can be varied.

Figure 3:
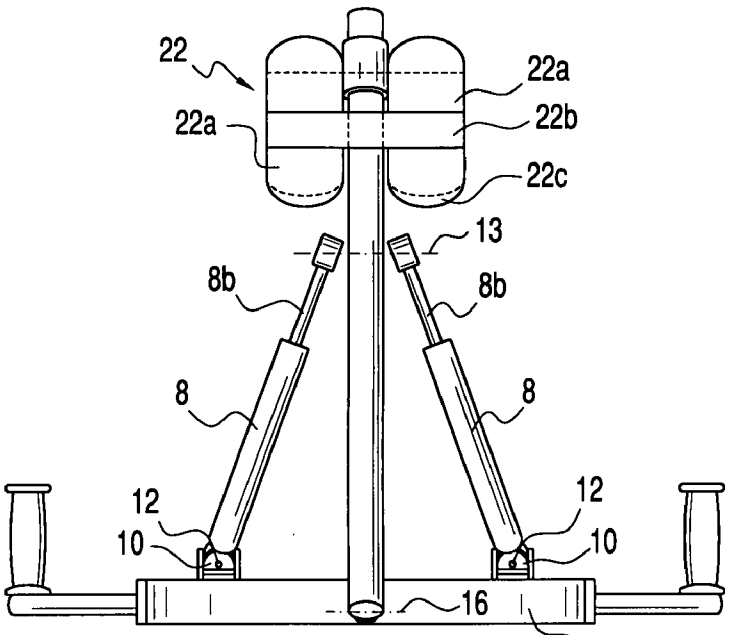
FIG. 3 is an end elevational view.

Referring to FIGS. 1, 2 and 3, the upper end portion of the mast 14 is provided with a footrest 22 having a pair of sole support plates 22*a* integrally connected to the mast 14 by a plate 22*b* extending between the sole support plates 22*a*. The footrest 22 also includes heel supports 22*c* on the lower end portions of the sole support plates 22*a*.

The upper end of the mast 14 is provided with a bolster 23 integrally connected to a sleeve 24 slidably mounted on the mast 14 and biased downwardly in a direction toward the footrest 22 by a tension spring 25 connected between the sleeve 24 and the mast 14. By this construction and arrangement, the user's feet are placed between the bolster 23 and footrest 22 so that the soles and heels of the feet engage the sole support plates 22*a* and heel supports 22*c*, respectively, and the bolster 23 engages the insteps. By slidably mounting the bolster 23 on the mast 14, various sizes of feet can be accommodated.

To complete the structural description of the exercise machine 1 of the present invention, the mast 14 is configured on a modified S configuration to thereby position the footrest 22 closer to the end of the bench which allows the use of a shorter bench, whereby the recumbent utilizes the whole bench with no wasted space.

In the operation of the exercise machine 1 of the present invention, an exerciser lies on the bench mattress 4 with the feet positioned on the footrest 22 and the insteps under the bolster. The handles 7 are grasped by the exerciser and the mast 14 is pushed and pulled forward and backward against the resistance afforded by the double-acting hydraulic cylinders 8.

The recumbent can not only exercise the main and lower abdominal muscles by pushing and pulling the mast in a direction aligned with the longitudinal axis of the bench but also the side or oblique muscles by pivoting the mast in a transverse direction while simultaneously pushing and pulling the mast.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. An abdominal exercise machine comprising a bench for supporting a recumbent exerciser thereon, a mast, a universal pivot connecting one end portion of said mast to one end of said bench, whereby the mast is pivotal in a direction along the longitudinal axis of the bench and in a direction transverse to the longitudinal axis of the bench, resistance means connected between the mast and said one end of the bench, and foot support means connected to an opposite end portion of the mast for supporting the feet of an exerciser recumbent on the bench, whereby the exerciser can pivot the mast forward and backward in a direction along the longitudinal axis of the bench against the resistance means for exercising the abdominal muscles, and in a transverse direction for exercising the oblique muscles.

2. An abdominal exercise machine according to claim 1, wherein the universal pivot comprises a bracket integrally connected to the lower end portion of the mast, a sleeve fixedly connected to said one end portion of the bench, a stub shaft rotatably mounted in said sleeve having an end portion extending outwardly thereupon, a transversely extending pivot pin connecting the end portion of said shaft to said bracket.

3. An abdominal exercise machine according to claim 2, wherein the stub shaft is axially slidable in said sleeve, and detent means connected between the sleeve and the stub shaft, whereby the axial position of the shaft within the sleeve can be adjusted, to thereby vary the position of the transversely extending pivot pin, whereby the force of the resistance means can be varied.

4. An abdominal exercise machine according to claim 3, wherein the detent means comprises axially spaced lands on said stub shaft providing axially spaced grooves therebetween, a transverse plunger extending through a sidewall of the sleeve, an end of the plunger adapted to be received in a selected groove, and a compression spring connected to said plunger for biasing the plunger in a direction inwardly of the housing.

5. An abdominal exercise machine according to claim 1, wherein the resistance means comprises at least one double-acting fluid cylinder, a universal pivot connecting one end of said fluid cylinder to the end portion of said bench, and a pivot connection connecting the opposite end of said fluid cylinder to the mast.

6. An abdominal exercise machine according to claim 5, wherein the universal pivot comprises a bracket connected to the end portion of said bench, a clevis, a first pivot pin connecting said clevis to said bracket about a transverse axis, and a second pivot pin connecting said one end of said fluid cylinder to said clevis on an axis normal to said first pivot pin.

7. An abdominal exercise machine according to claim 1, wherein the resistance means comprises a pair of double-acting fluid cylinders positioned on each side of said mast, the rod end of each fluid cylinder being connected to the mast, and the cylinder end of each fluid cylinder being connected to the end portion of the bench.

8. An abdominal exercise machine according to claim 1, wherein the foot support means comprises a pair of foot rests integrally connected to the mast, a bolster spaced inwardly from said foot rest and slidably mounted on said mast, whereby the exerciser's feet are supported on the foot rests and the bolster engages the insteps.

9. An abdominal exercise machine according to claim 8, wherein a tension spring is connected between the mast and bolster for biasing the bolster in a direction toward the foot rests.

10. An abdominal exercise machine according to claim 1, wherein a pair of arms are pivotally connected to the sides of the bench, and a handle is connected to the free end of each arm adapted to be grasped by the exerciser while recumbent on the bench.

11. An abdominal exercise machine according to claim 1, wherein the mast has a selected configuration, whereby the foot support means is positioned closer to the end of the bench, to thereby facilitate the use of a shorter bench.

* * * * *